US012214425B2

(12) United States Patent
Lee et al.

(10) Patent No.: US 12,214,425 B2
(45) Date of Patent: Feb. 4, 2025

(54) METHOD FOR MANUFACTURING COMPOSITE MATERIAL, AND COMPOSITE MATERIAL

(71) Applicant: LG CHEM, LTD., Seoul (KR)

(72) Inventors: Yeon Soo Lee, Daejeon (KR); Dong Woo Yoo, Daejeon (KR); Jin Kyu Lee, Daejeon (KR)

(73) Assignee: LG CHEM, LTD., Seoul (KR)

( * ) Notice: Subject to any disclaimer, the term of this patent is extended or adjusted under 35 U.S.C. 154(b) by 435 days.

(21) Appl. No.: 17/617,328

(22) PCT Filed: Jun. 17, 2020

(86) PCT No.: PCT/KR2020/007823
§ 371 (c)(1),
(2) Date: Dec. 8, 2021

(87) PCT Pub. No.: WO2020/256394
PCT Pub. Date: Dec. 24, 2020

(65) Prior Publication Data

US 2022/0219233 A1 Jul. 14, 2022

(30) Foreign Application Priority Data

Jun. 17, 2019 (KR) ..... 10-2019-0071483

(51) Int. Cl.
*B22F 3/26* (2006.01)
*B22F 3/11* (2006.01)

(52) U.S. Cl.
CPC ..... *B22F 3/26* (2013.01); *B22F 3/1103* (2013.01); *B22F 3/1146* (2013.01)

(58) Field of Classification Search
CPC ..... B22F 7/006; B22F 2003/1131; B22F 2003/1128; B22F 3/1125; B22F 3/1146; B22F 3/26
See application file for complete search history.

(56) References Cited

U.S. PATENT DOCUMENTS

2007/0029251 A1 2/2007 Lee et al.
2014/0116661 A1 5/2014 Xu et al.

FOREIGN PATENT DOCUMENTS

DE 102015220504 A1 4/2017
DE 102017121512 A1 3/2019
(Continued)

OTHER PUBLICATIONS

International Search Report corresponding to PCT/KR2020/007823; dated Sep. 23, 2020 (5 pages, including English translation).

(Continued)

*Primary Examiner* — Stella K Yi
(74) *Attorney, Agent, or Firm* — Saliwanchik, Lloyd & Eisenschenk

(57) ABSTRACT

Methods for manufacturing a composite material and composite materials are provided. The method may include preparing a metal foam, preparing a mixture including the metal foam and a curable polymer, curing the curable polymer of the mixture to obtain a composite material, and performing a planarization treatment. The planarization treatment may be performed on the metal foam before preparing the mixture, on the mixture before curing the curable polymer, and/or on the composite material. The composite materials may include a metal foam and a polymer that is on a surface and/or in pores of the metal foam. The composite material may have a surface roughness of 2 μm or less and/or may have a thermal resistance of 0.5 $Kin^2/W$ or less at 20 psi.

8 Claims, 9 Drawing Sheets

(56) References Cited

FOREIGN PATENT DOCUMENTS

| | | | | |
|---|---|---|---|---|
| JP | H06103885 | A | | 4/1994 |
| JP | H09162336 | A | | 6/1997 |
| JP | 2001329303 | A | | 11/2001 |
| JP | 2002212309 | A | | 7/2002 |
| JP | 2007216234 | A | | 8/2007 |
| JP | 2009249657 | A | | 10/2009 |
| JP | 2014239176 | A | | 12/2014 |
| JP | 2018148053 | A | | 9/2018 |
| KR | 970073821 | A | | 12/1997 |
| KR | 101627112 | B1 | | 6/2016 |
| KR | 101749461 | B1 | | 6/2017 |
| KR | 20170113413 | A | | 10/2017 |
| KR | 20180062170 | A | | 6/2018 |
| KR | 1020180062171 | A | | 6/2018 |
| KR | 1020190030980 | A | | 3/2019 |
| KR | 1020190033875 | A | | 4/2019 |
| WO | WO9222420 | | * | 12/1992 |
| WO | 2018087076 | A1 | | 5/2018 |

OTHER PUBLICATIONS

Extended European Search Report corresponding to EP 20827585.9 mailed Jun. 27, 2022 (9 pages).

* cited by examiner (a)

(b)

METHOD FOR MANUFACTURING COMPOSITE MATERIAL, AND COMPOSITE MATERIAL

CROSS-REFERENCE TO RELATED APPLICATIONS

This application is a 35 U.S.C. § 371 national stage application of PCT International Application No. PCT/KR2020/007823, filed Jun. 17, 2020, which claims priority from Korean Patent Application No. 10-2019-0071483, filed Jun. 17, 2019, the contents of which are incorporated herein in their entireties by reference. The above-referenced PCT International Application was published in the Korean language as International Publication No. WO2020/256394 on Dec. 24, 2020.

TECHNICAL FIELD

The present application relates to a method for manufacturing a composite material, and a composite material.

BACKGROUND ART

Metal foams have various and useful properties such as lightweight properties, energy absorptive properties, heat insulating properties, fire resistance or eco-friendliness. Therefore, the metal foam can be applied to various fields such as lightweight structures, transport machinery, building materials or energy absorbing devices. The metal foam has a high specific surface area and can improve the flow of electrons or fluids such as liquids and gases. Therefore, the metal foam may also be usefully used for a substrate for a heat exchange device, a catalyst, a sensor, an actuator, a secondary battery or a microfluidic flow controller, and the like. In particular, since the metal foam has metal components showing high thermal conductivity and has a structure in which they are interconnected, it can be mainly applied as a heat radiation material.

However, since the pores inside the metal foam are somewhat irregularly formed, the outermost surface of the metal foam is not flat. For this reason, when the metal foam is applied as a thermal interface material (TIM), there is a problem that the bonding area of the material in contact with the metal foam decreases, and accordingly, the heat transfer efficiency of the relevant material decreases.

DISCLOSURE

Technical Problem

It is one object of the present application to manufacture a composite material having high heat conduction efficiency.

It is another object of the present application to manufacture a composite material capable of securing stability in an oxidizing and/or high-temperature atmosphere, or the like.

It is another object of the present application to manufacture a composite material capable of preventing occurrence of peeling problems or the like, particularly when applied as a heat radiation material.

Technical Solution

The present application relates to a method for manufacturing a composite material. The method for manufacturing a composite material of the present application comprises steps of (a) preparing at least a metal foam; (b) preparing a mixture comprising the metal foam and a curable polymer; and (c) curing the curable polymer of the mixture to obtain a composite material.

In the present application, the term "curable" may mean a property capable of crosslinking and/or curing by irradiation of light, application of heat, application of an external magnetic field, or the like. That is, the curable polymer may mean a polymer exhibiting a property capable of being cured by an external stimulus such as irradiation of light or application of heat.

In the present application, the term "metal foam" means a porous structure comprising a metal as a main component.

Here, the inclusion of any component as a main component may mean that the ratio of the component is 55 weight % or more, 60 weight % or more, 65 weight % or more, 70 weight % or more, 75 weight % or more, 80 weight % % or more, 85 weight % or more, 90 weight % or more, or 90 weight % or more, and 100 weight % or less, 99 weight % or less, or 98 weight % or less or so, based on the total weight.

In the present application, the term "porous property" may mean a case where porosity of the relevant material is 10% or more, 20% or more, 30% or more, 40% or more, 50% or more, 60% or more, 70% or more, 75% or more, or 80% or more. The upper limit of the porosity is not particularly limited, which may be, for example, less than about 100%, about 99% or less, or about 98% or less, 95% or less, 90% or less, 85% or less, 80% or less, or 75% or less or so. The porosity can be calculated in a known manner by calculating the density of the metal foam or the like.

Among the physical properties mentioned in the present application, when the measured temperature affects the relevant physical property, the physical property is measured at room temperature, unless otherwise specified.

Here, the term "room temperature" may mean a natural temperature without warming or cooling, for example, any one temperature within the range of 10° C. to 30° C., or a temperature of about 23° C. or about 25° C. or so.

The method of the present application further comprises a planarization treatment step (d). In the method of the present application, by performing the planarization treatment, a composite material having lower surface roughness and simultaneously improved thermal conductivity can be manufactured.

In general, the pores inside the metal foam are formed somewhat irregularly. Therefore, the outer surface of the metal foam is not flat. For this reason, when the metal foam is applied as a thermal interface material (TIM) or a heat radiation material, there is a problem that the heat conduction efficiency decreases. This is because the outer surface of the metal foam is not flat, so that the bonding area between the metal foam and the material in contact with the metal foam decreases. In order to form a flat surface of the metal foam, a method of adding plate-shaped inorganic nanoparticles such as nanoclay without applying separate external force to the surface of the metal foam was considered. However, with the above method, there is a limitation in improving the heat transfer efficiency of the composite material comprising the metal foam and the polymer component, and there is a problem that the manufacturing process cost increases because the additional component is applied.

Accordingly, the present inventors have devised the present invention as a result of searching for a method capable of producing a smooth surface of a composite material while applying the existing metal foam as it is. Specifically, the present inventors have confirmed that by planarization-treating at least one of a metal foam precursor, a metal foam, a mixture of a metal foam and a curable polymer, and a composite material in the manufacturing process of the composite material, the composite material with high thermal conductivity can be obtained even with a simple process, and devised the present invention.

In the present application, the term "planarization treatment" is used as a meaning including a series of treatment processes for so-called "smoothing" the surface of the material to be treated. Specifically, the term "planarization treatment" may mean a series of actions for treating the material to be treated so that uneven portions do not exist on its surface, or even if they exist, so that their existence ratio is extremely small.

In the method of the present application, the planarization treatment step (d) is performed at least one time point from the pre-step (a) to the post-step (c). Specifically, in the method of the present application, the planarization treatment (d) is performed at least one time point of the following time points (1) to (4):

(1) before preparation of a metal foam
(2) after preparation of a metal foam
(3) after preparing a mixture comprising a metal foam and a curable polymer
(4) after curing the curable polymer of the mixture comprising the metal foam and the curable polymer That is, in the method of the present application, the planarization treatment process may be performed (i) during the manufacture of the metal foam, (ii) after the manufacture of the metal foam and before mixing with the curable polymer, (iii) during the mixing of the metal foam and the curable polymer, (iv) after the manufacture of the mixture, (iv) during the curing process of the curable polymer and/or (v) after the manufacture of the composite material.

Meanwhile, from the viewpoint of appropriately adjusting the degree of the planarization treatment and maximizing the improvement of the heat conduction efficiency according to the treatment degree, the planarization treatment step may be advantageously performed on the metal foam. For example, when the planarization treatment is performed in the manufacturing process of the metal foam, there may also be a problem that the precursor of the metal foam is peeled off from a base material supporting the same, and there may be a limit to the degree of planarization. In addition, if the planarization treatment is performed after mixing the metal foam and the curable polymer and before curing them, it may not be easy to stably perform the planarization treatment process because the curable polymer is a liquid component. When a metal foam and a curable polymer are mixed and the curable polymer of the mixture is cured and then planarization-treated, there may be inevitably a limit to improving the degree of planarization because the elastic curable polymer still exists inside the metal foam. That is, in a preferred embodiment of the present application, it may be preferable that the planarization treatment is performed on a state where the internal pores are empty, that is, the metal foam, and then the manufacturing process of a composite material of the present application is performed.

That is, in one example of the method of the present application, the step (d) may be performed between the step (a) and the step (b). That is, the exemplary metal foam applied in the method of the present application may be a planarization-treated metal foam.

In one example, when the method of the present application performs the planarization treatment on the metal foam, the degree of the progress may be further adjusted. For example, when the planarization treatment is performed on the metal foam, the method of the present application may be performed such that the porosity of the metal foam in a range of 30% to 60%. In another example, the porosity may be 35% or more, or 40% or more, and may be 55% or less, or 50% or less.

In another example, when the planarization treatment is performed on the metal foam, the method of the present application may be performed such that the surface roughness of the metal foam is 6 μm or less.

In the present application, the term "surface roughness" may mean one quantitatively indicating how smooth or rough the surface of a target material is. Measurement methods of (1) center line average roughness (Ra), (2) maximum height roughness (Rmax) and (3) 10-point average roughness (Rz), and the like as the surface roughness are known. The meaning of the surface roughness applied in the present application may mean one measured according to any one of the above methods. In the present application, the average roughness of the center line (Ra) has been actually applied as the surface roughness, and the measurement method thereof is the same as described in Examples to be described below.

Here, the method of adjusting the porosity and/or surface roughness of the metal foam achieved by the planarization treatment is not particularly limited. The porosity and/or surface roughness may be adjusted by appropriately adjusting a specific method of planarization treatment and conditions thereof, which are described below.

For example, in the manufacturing method of the present application, the planarization treatment step may be performed by a polishing or pressing method, and the like.

Here, the polishing means a known treatment method that the surface of the object to be treated is rubbed with the edge or surface of another object to smooth the surface. As the polishing method, all known polishing methods (for example, a method of using an abrasive, or a method of applying a polishing stone or the like) can be applied.

Here, the pressing may mean a process of applying pressure to an object to be treated and pressing the portions protruded from the object to be treated, thereby flattening the surface. The pressing method is not particularly limited, where a known pressuring method may be applied. For example, a hydraulic press or a roll press may be applied as the pressing method. From the viewpoint of thin-film formation of the metal foam, it may be appropriate to apply the roll press method. For example, in the method of the present application, by passing the previously manufactured metal foam between two rolls provided in the press equipment, the metal foam may be subjected to pressing by the roll press method.

The shape of the metal foam is not particularly limited, but in one example, the shape of the metal foam before the planarization treatment may be a film or sheet shape. In addition, the metal foam subjected to the planarization treatment, specifically the pressing, more specifically, the pressing using the roll press may exist in the form of a film or a sheet regardless of the form before the treatment. Furthermore, the thickness or porosity, and the like of the metal foam can be reduced by pressing.

In one example, when the metal foam before the planarization treatment (specifically, pressing, more specifically pressing using a roll press) is in the film or sheet shape, the thickness may be 2000 μm or less. In another example, it may be 1900 μm or less, 1800 μm or less, 1700 μm or less, 1600 μm or less, 1500 μm or less, 1400 μm or less, 1300 μm or less, 1200 μm or less, 1100 μm or less, or 1000 or less, and may be 10 μm or more, 20 μm or more, 30 μm or more, 40 μm or more, 50 μm or more, 60 μm or more, 70, μm or more, 80 μm or more, or 85 μm or more.

In the present application, the thickness of a member may be directly measured on the relevant member using a thickness gauge, or calculated indirectly by a method of analyzing a photograph of the relevant member, or the like. In addition, when the thickness of the relevant member is not constant, the thickness may be a maximum thickness, a minimum thickness, or an average thickness of the member.

In one example, the porosity of the metal foam before the planarization treatment (specifically, pressing, more specifically pressing using a roll press) may be 60% or more. In another example, the porosity may be 61% or more, 62% or more, 63% or more, or 64% or more, and may be less than 100%, 95% or less, 90% or less, 85% or less, 80% or less, or 75% or less. As a method of measuring the porosity, the above-described method may be applied.

As described above, the thickness of the metal foam may be reduced according to the planarization treatment (specifically, pressing, more specifically, pressing using a roll press). Therefore, in one example, a ratio (TA/TB) of the thickness (TA) of the metal foam after the planarization treatment to the thickness (TB) of the metal foam before the planarization treatment and may be 0.9 or less. In another example, the ratio may be 0.87 or less, 0.86 or less, 0.85 or less, 0.84 or less, or 0.83 or less, and may be 0.05 or more, 0.1 or more, 0.15 or more, 0.2 or more, 0.25 or more, 0.3 or more, 0.35 or more, 0.4 or more, 0.45 or more.

The porosity of the metal foam may also be reduced according to the planarization treatment (specifically, pressing, more specifically pressing using a roll press). Therefore, in one example, a ratio (PA/PB) of the porosity (PA) of the metal foam after the planarization treatment to the porosity (PB) of the metal foam before the planarization treatment may be 0.95 or less. In another example, the ratio may be 0.94 or less, 0.93 or less, 0.92 or less, 0.91 or less, or 0.9 or less, and may be 0.05 or more, 0.1 or more, 0.15 or more, 0.2 or more, 0.25 or more, 0.3 or more, 0.35 or more, 0.4 or more, 0.45 or more, 0.5 or more, 0.55 or more, or 0.6 or more.

In the present application, in order to secure an appropriate thermal conductivity and the like, the pore characteristics of the metal foam may also be additionally controlled. For example, the metal foam may comprise, approximately, spherical, needle-shaped or amorphous pores, or the like. For example, the metal foam may have a maximum pore size of 50 μm or less, 45 μm or less, 40 μm or less, 35 μm or less, or 30 μm or less or so. In another example, the maximum pore size may be 2 μm or more, 4 μm or more, 6 μm or more, 8 μm or more, 10 μm or more, 12 μm or more, 14 μm or more, 16 μm or more, 18 μm or more, 20 μm or more, 22 μm or more, 24 μm or more, or 26 μm or more.

In one example, the pores of 85% or more of the total pores in the metal foam may have a size of 10 μm or less, and the pores of 65% or more may have a size of 5 μm or less. Here, the lower limit of the size of the pores having a pore size of 10 μm or less or 5 μm or less is not particularly limited, but in one example, it may be more than 0 μm, 0.1 μm or more, 0.2 μm or more, 0.3 μm or more, 0.4 μm or more, 0.5 μm or more, 0.6 μm or more, 0.7 μm or more, 0.8 μm or more, 0.9 μm or more, 1 μm or more, 1.1 μm or more, 1.2 μm or more, 1.3 μm or more, 1.4 μm or more, 1.5 μm or more, 1.6 μm or more, 1.7 μm or more, 1.8 μm or more, 1.9 μm or more, or 2 μm or more.

In addition, here, the pores having a pore size of 10 μm or less may be 100% or less, 95% or less, or 90% or less or so of the total pores, and the ratio of pores having a pore size of 5 μm or less may be 100% or less, 95% or less, 90% or less, 85% or less, 80% or less, 75% or less, or 70% or less or so of the total pores.

The desired composite material may be manufactured by such pore distribution or pore characteristics. When the composite material or metal foam is in the form of a film or sheet, the pore distribution may be determined, for example, based on the long axis direction of the film.

Also, in the present application, the metal foam is applied in the form of planarization treatment (specifically, pressing, more specifically pressing using a roll press), so that the pore characteristics in the metal foam can be made in a compact form according to the planarization treatment. For example, the pores included in the planarization-treated metal foam may comprise pores having a maximum pore size smaller than that of the pores included in the metal foam before the planarization treatment.

For example, a ratio (SA/SB) of the maximum pore size (SA) of the metal foam after the planarization treatment to the maximum pore size (SB) of the metal foam before the planarization treatment may be 0.9 or less. In another example, the ratio may be 0.85 or less, 0.8 or less, 0.75 or less, 0.7 or less, 0.65 or less, 0.6 or less, 0.55 or less, or 0.5 or less. In addition, the lower limit of the ratio is not particularly limited, but it may be, for example, 0.05 or more, 0.1 or more, 0.15 or more, 0.2 or more, 0.25 or more, 0.3 or more, 0.35 or more, 0.4 or more, 0.45 or more.

In one example, the surface roughness of the metal foam before the planarization treatment may be 20 μm or less. In another example, the value may be 19 μm or less, 18 μm or less, 17 μm or less, 16 μm or less, 15 μm or less, 14 μm or less, 13 μm or less, 12 μm or less, 11 μm or less, or 10 μm or less, and may be 5 μm or more, 6 μm or more, 7 μm or more, or 7.5 μm or more.

In addition, since the thickness, porosity or maximum pore size, and the like of the metal foam is reduced by the planarization treatment, the surface roughness of the metal foam may also be reduced by the planarization treatment. In one example, a ratio (RA/RB) of the surface roughness (RA) of the metal foam after the planarization treatment to the surface roughness (RB) of the metal foam before the planarization treatment may be 0.9 or less. In another example, the ratio may be 0.85 or less, 0.8 or less, 0.75 or less, or 0.7 or less, and may be 0.05 or more, 0.1 or more, 0.15 or more, 0.2 or more, 0.25 or more, 0.3 or more, 0.35 or more, or 0.4 or more.

Since the surface roughness of the metal foam is reduced by the planarization treatment, the thermal resistance of the metal foam affected by the surface roughness may also be reduced by the planarization treatment.

In one example, the thermal resistance of the metal foam before the planarization treatment may be 2 $Kin^2/W$ or less. In another example, the value may be 1.9 $Kin^2/W$ or less, 1.8 $Kin^2/W$ or less, 1.7 $Kin^2/W$ or less, 1.6 $Kin^2/W$ or less, 1.5 $Kin^2/W$ or less, 1.4 $Kin^2/W$ or less, 1.3 $Kin^2/W$ or less, 1.2 $Kin^2/W$ or less, or 1.1 $Kin^2/W$ or less, and may be 0.1 $Kin^2/W$ or more, 0.15 $Kin^2/W$ or more, 0.2 $Kin^2/W$ or more, 0.25 $Kin^2/W$ or more, 0.3 $Kin^2/W$ or more, 0.35 $Kin^2/W$ or more, 0.4 $Kin^2/W$ or more, or 0.45 $Kin^2/W$ or more.

In one example, a ratio (KA/KB) of the thermal resistance (KA) of the metal foam after the planarization treatment to the thermal resistance (KB) of the metal foam before the planarization treatment may be 0.9 or less. In another example, the ratio may be 0.85 or less, 0.8 or less, or 0.75 or less, and may be 0.1 or more, 0.15 or more, 0.2 or more, 0.25 or more, 0.3 or more, 0.35 or more, 0.4 or more, or 0.45 or more.

The methods for manufacturing a metal foam are known in various manners. In the present application, a metal foam manufactured in a known manner may be applied.

In one example, the metal foam may also be manufactured using a slurry. Specifically, the metal foam may also be manufactured using a slurry comprising at least a metal powder, a binder and a dispersant. Specifically, the metal foam may be manufactured in a manner comprising at least a process (a1) of forming a green structure (a precursor of a metal foam) using the slurry and a process (a2) of sintering the green structure. That is, the method of the present application may perform the step (a) in a manner comprising the process (a1) and the process (a2).

In the present application, the term "green structure" means a structure before undergoing a process performed to form a metal foam, such as the sintering, that is, a structure before generating a metal foam. In addition, even if the green structure is referred to as a porous metal foam precursor, it does not necessarily need to be porous by itself, and it may also be referred to as a porous metal foam precursor for convenience as long as it can finally form a metal foam that is a porous metal structure.

In one example, the type of the metal powder is determined according to the purpose of application and is not particularly limited. For example, as the metal powder, any one selected from the group consisting of copper powder, phosphorus powder, molybdenum powder, zinc powder, manganese powder, chromium powder, indium powder, tin powder, silver powder, platinum powder, gold powder, aluminum powder and magnesium powder, or a mixture of two or more of the foregoing, or alloy powder of two or more of the foregoing may be applied.

In one example, the size of the metal powder may be selected in consideration of the desired porosity or pore size, and the like. For example, the average particle diameter of the metal powder may be in a range of 0.1 μm to 200 μm. In another example, the average particle diameter may be 0.5 μm or more, 1 μm or more, 2 μm or more, 3 μm or more, 4 μm or more, 5 μm or more, 6 μm or more, 7 μm or more, or 8 μm or more, and may be 150 μm or less, 100 μm or less, 90 μm or less, 80 μm or less, 70 μm or less, 60 μm or less, 50 μm or less, 40 μm or less, 30 μm or less, or 20 μm or less. The average particle diameter may be adjusted to an appropriate range in consideration of the shape of the desired metal foam, for example, the thickness or porosity of the metal foam, and the like.

Here, the average particle diameter of the metal powder may be measured by a known particle size analysis method. For example, the average particle diameter of the metal powder may be a so-called D50 particle diameter.

The ratio of the metal powder in the slurry is not particularly limited. For example, the slurry may comprise 10 weight % to 70 weight % of metal powder. In another example, the ratio may be 15 weight % or more, 20 weight % or more, 25 weight % or more, 30 weight % or more, 35 weight % or more, 40 weight % or more, 45 weight % or more, or 50 weight % or more, and may be 65 weight % or less, 60 weight % or less, 55 weight % or less, or 50 weight % or less.

In one example, alcohol may be applied as the dispersant. As the alcohol, a monohydric alcohol having 1 to 20 carbon atoms, such as methanol, ethanol, propanol, butanol, pentanol, ethylene glycol, propylene glycol, glycerol, texanol or terpineol; or a dihydric alcohol or a polyhydric alcohol above a trihydric alcohol, having 1 to 20 carbon atoms or more polyhydric alcohols, such as ethylene glycol, propylene glycol, hexanediol, octanediol, or pentanediol, may be used, but the type is not limited to the above examples.

The type of the binder is not particularly limited, which may be appropriately selected according to the type of metal component or dispersant to be applied when preparing the slurry. For example, as the binder, alkyl celluloses having an alkyl group with 1 to 8 carbon atoms such as methyl cellulose or ethyl cellulose; polyalkylene carbonates having an alkylene unit with 1 to 8 carbon atoms such as polypropylene carbonate or polyethylene carbonate; polyalkylene oxides having an alkylene unit with 1 to 8 carbon atoms such as polyethylene oxide or polypropylene oxide; or a polyvinyl alcohol-based binder such as polyvinyl alcohol or polyvinyl acetate, and the like may be used.

In the slurry, the ratio of the components is not particularly limited. The ratio may be adjusted in consideration of process efficiency such as coating property or moldability during the process of using the slurry.

In one example, the slurry may comprise a binder in a ratio of 5 to 500 parts by weight relative to 100 parts by weight of the metal powder. In another example, the ratio may be 6 parts by weight or more, or 7 parts by weight or more, and may be 450 parts by weight or less, 400 parts by weight or less, 350 parts by weight or less, 300 parts by weight or less, 250 parts by weight or less, 200 parts by weight or less, 150 parts by weight or less, 100 parts by weight or less, 50 parts by weight or less, 30 parts by weight or less, 20 parts by weight or less, 15 parts by weight or less, or 10 parts by weight or less.

In one example, the slurry may comprise a dispersant in a ratio of 100 parts by weight to 2000 parts by weight relative to 100 parts by weight of the binder. In another example, the ratio may be 150 parts by weight or more, 200 parts by weight or more, 250 parts by weight or more, 300 parts by weight or more, 350 parts by weight or more, 400 parts by weight or more, 450 parts by weight or more, 500 parts by weight or more, 550 parts by weight or more, 600 parts by weight or more, 650 parts by weight or more, 700 parts by weight or more, 750 parts by weight or more, 800 parts by weight or more, 850 parts by weight or more, 900 parts by weight or more, 950 parts by weight or more, 1000 parts by weight or more, 1050 parts by weight or more, 1100 parts by weight or more, 1150 parts by weight or more, 1200 parts by weight or more, 1250 parts by weight or more, or 1300 parts by weight or more, and may be 1800 parts by weight or less, 1600 parts by weight or less, 1400 parts by weight or less, or 1350 parts by weight or less.

In the present application, the unit "parts by weight" means a ratio of weight between the respective components, unless otherwise specified.

If necessary, the slurry may also further comprise a solvent to improve foamability of the slurry. As the solvent, a suitable solvent may be used in consideration of solubility with the slurry components such as for example, the metal powder and the binder. For example, as the solvent, one having a dielectric constant in a range of 10 to 120 may be used. In another example, the dielectric constant may be about 20 or more, about 30 or more, about 40 or more, about 50 or more, about 60 or more, or about 70 or more, and may be about 100 or less, about 100 or less, or about 90 or less. As the above-described solvent, water; alcohols having 1 to 8 carbon atoms such as ethanol, butanol or methanol; or DMSO (dimethyl sulfoxide), DMF (dimethyl formamide) or NMP (N-methylpyrrolidone), and the like may be used, without being limited thereto.

When a solvent is applied, the slurry may comprise the solvent in a ratio of about 50 to 400 parts by weight relative to 100 parts by weight of the binder. However, the ratio is not limited thereto.

In addition to the above-mentioned components, the slurry may also comprise additionally necessary known additives.

The method of forming the metal foam precursor using the slurry as above is not particularly limited. In the field of manufacturing a metal foam, various methods for forming a metal foam precursor are known, and all of these methods can be applied in the present application. For example, the metal foam precursor may be formed by a method of maintaining the slurry in an appropriate template, or coating the slurry in an appropriate manner and then drying it, and the like.

If necessary, an appropriate drying process may also be performed in the process of forming the metal foam precursor. For example, a metal foam precursor may also be formed by molding the slurry in the above-described manner and then drying the slurry for a predetermined period of time. The drying conditions are not particularly limited, and, for example, components, such as moisture, that the solvent or binder contained in the slurry comprises may be controlled at a level capable of removing them to a desired level. For example, the drying may be performed by maintaining the molded slurry at a temperature in the range of 50° C. to 250° C., 70° C. to 180° C., or 90° C. to 150° C. for an appropriate time. The drying time may also be adjusted within an appropriate range.

The metal foam may be manufactured by sintering the metal foam precursor formed in the same manner as above. In this case, a method of performing sintering for manufacturing the metal foam is not particularly limited, and a known sintering method may be applied. That is, the sintering may be performed by applying an appropriate amount of heat to the metal foam precursor by an appropriate method.

In one example, the sintering may also be performed by applying an external heat source to the metal foam precursor. In this case, the temperature of the heat source may be in the range of 100° C. to 1200° C.

In the manufacturing method of the present application, a mixture comprising the metal foam and a curable polymer may be prepared in various ways in in the step (b) above. For example, (1) a mixture may be prepared by immersing the metal foam in a curable polymer present in the form of a composition, (2) a liquid or semi-solid curable polymer may be applied to the metal foam to prepare the mixture, or (3) the mixture may be prepared by injecting a curable polymer into the pores of the metal foam. In the step (b) above of the method of the present application, the mixture may be prepared in a non-limiting manner such that a curable polymer can exist on the surface and/or pores of the metal foam, in addition to the above-listed methods.

For example, when a mixture comprising a metal foam after the planarization treatment and a curable polymer is prepared, the curable polymer may be present on the surface and/or inside of the planarization-treated metal foam. Specifically, the curable polymer may be present by forming a surface layer on at least one surface of the planarization-treated metal foam, or by filling the voids inside the metal foam. In addition, the polymer component may also be optionally filled inside the metal foam while forming the surface layer. When the polymer component forms a surface layer, the polymer component may form a surface layer on at least one surface, a part of the surface, or all surfaces of the metal foam.

The type of the curable polymer is not particularly limited. For example, the type of the polymer component may be selected in consideration of the processability, impact resistance, and insulation properties of the composite material, and the like. As the polymer component, at least one of known acrylic resins, silicone resins such as siloxane-based resins, epoxy resins, olefin resins such as PP (polypropylene) or PE (polyethylene), polyester resins such as PET (polyethylene terephthalate), polyamide resins, urethane resins, amino resins and phenol resins may be applied, without being limited thereto.

In the mixture comprising the metal foam and the curable polymer, the ratio of the metal foam and the curable polymer is not particularly limited. For example, when the curable polymer is in a liquid phase, the metal foam and the curable polymer may also be mixed to the extent that the metal foam can be sufficiently immersed in the curable polymer. That is, in the manufacturing method of the present application, a composite material may be manufactured by allowing the curable polymer to exist on the surface or inside of the metal foam, and then curing the curable polymer.

In one example, a ratio (MV/PV) of the volume (MV) of the planarization-treated metal foam to the volume (PV) of the curable composition may be 10 or less. In another example, the ratio may be 9 or less, 8 or less, 7 or less, 6 or less, 5 or less, 4 or less, 3 or less, 2 or less, 1 or less, or 0.5 or less, and may be 0.05 or more, 0.1 or more, or 0.3 or more. The ratio can be calculated through the weights of the curable polymer and the metal foam contained in the composite material manufactured by the above method and the densities of the corresponding components, and the like.

The manner and method of curing the curable polymer in the mixture, and the like are also not particularly limited. That is, the composite material may be prepared by curing the mixture through a known manner. In one example, the composition may be cured by applying an external heat source to the mixture. At this time, the temperature of the heat source may be in the range of 50° C. to 200° C. In another example, the temperature may be 60° C. or more, 70° C. or more, 80° C. or more, 90° C. or more, 100° C. or more, 110° C. or more, or 120° C. or more, and may be 190° C. or less, 180° C. or less, 170° C. or less, 160° C. or less, 150° C. or less, 140° C. or less, 130° C. or less, or 120° C. or less.

In addition, the curing time may also be selected within an appropriate range. For example, the curing may be performed for a time in the range of 1 minute to 10 hours. In another example, the curing time may be in the range of 10 minutes to 5 hours, 10 minutes to 3 hours, or 10 minutes to 1 hour.

The present application also relates to a composite material. Specifically, the composite material may be manufactured by the above-described method.

The composite material of the present application comprises a metal foam and a polymer component. In addition, the composite material of the present application has a smooth surface and high thermal conductivity (low thermal resistivity). Therefore, the composite material of the present application comprises a metal foam and a curable polymer component present on the surface of the metal foam and in the pores of the metal foam.

The surface roughness of the composite material is 2 μm or less. In the definition, the measurement method, and the like of the surface roughness mentioned in the present application, the above-described meanings are applied thereto as they are. In another example, the surface roughness of the composite material may be 1.9 μm or less or 1.8 μm or less, and because the lower the lower limit is, the more advantageous it is, it is not particularly limited, but it may be 0.001 μm or more, 0.01 μm or more, 0.1 μm or more, or 1 μm or more.

The composite material has thermal resistance at 20 psi of 0.5 $Kin^2/W$ or less. In another example, the thermal resistance of the composite material may be 0.45 $Kin^2/W$ or less, 0.4 $Kin^2/W$ or less, 0.35 $Kin^2/W$ or less, or 0.33 $Kin^2/W$ or less, and because the lower the lower limit is, the more advantageous it is, it is not particularly limited, but it may be 0.001 $Kin^2/W$ or more, 0.01 $Kin^2/W$ or more, or 0.05 $Kin^2/W$ or more. In addition, the method of measuring the thermal resistance is not particularly limited, and a known measurement method may be applied. In one example, the thermal resistance of the composite material may be measured based on ASTM D5470 standard.

The contents of the metal foam and the polymer component applied in the composite material are as already described.

As described above, the porosity of the metal foam in the composite material may be in the range of 30% to 60%. In another example, the porosity of the metal foam may be 35% or more, or 40% or more, and may be 55% or less, or 50% or less. The method of identifying the porosity of the metal foam in the composite material is not particularly limited. In general, in the composite material, the polymer present in the composite material is degreased to leave only the metal foam, and the volume and density of the metal foam are measured, whereby the porosity of the metal foam can be calculated through a known method. Meanwhile, the degreasing of the polymer in the composite material may be performed through a heat treatment process in an oxidizing atmosphere (presence of an excessive amount of oxygen), where the metal constituting the metal foam may also be affected, but the difference is insignificant. That is, the porosity may mean the porosity of the metal foam applied in the manufacturing process of the composite material, and may also mean the porosity of the metal foam obtained after removing the polymer component from the previously prepared composite material.

From the viewpoint of securing the composite material having the above thermal resistance and surface roughness, it may be advantageous that the porosity of the metal foam in the composite material is in the range of 40% to 50%.

Since the metal foam may have a film or sheet form according to the planarization treatment, the composite material of the present application may also have a film or sheet form. At this time, the thickness of the composite material may be 2000 μm or less. In another example, it may be 1900 μm or less, 1800 μm or less, 1700 μm or less, 1600 μm or less, 1500 μm or less, 1400 μm or less, 1300 μm or less, 1200 μm or less, 1100 μm or less, or 1000 or less, and may be 10 μm or more, 20 μm or more, 30 μm or more, 40 μm or more, 50 μm or more, 60 μm or more, 70 μm or more, 80 μm or more, or 85 μm or more.

In one example, the composite material comprises a metal foam and a polymer component present on the surface or inside of the metal foam, where in such a composite material, a ratio (T/MT) of the total thickness of the composite material (T) to the thickness (MT) of the metal foam may be 2.5 or less. In another example, the ratio may be 2 or less, 1.9 or less, 1.8 or less, 1.7 or less, 1.6 or less, 1.5 or less, 1.4 or less, 1.3 or less, 1.2 or less, 1.15 or less, or 1.1 or less. The lower limit of the ratio is not particularly limited, but it may be about 1 or more, 1.01 or more, 1.02 or more, 1.03 or more, 1.04 or more, 1.05 or more, 1.06 or more, 1.07 or more, 1.08 or more, 1.09 or more, or 1.1 or more. Under such a thickness ratio, it is possible to provide a composite material having the desired thermal conductivity, and excellent processability and impact resistance, and the like.

The composite material may have high magnetic permeability due to multiple reflection and absorption, and the like, according to the unique surface area and pore characteristics of the metal foam. Also, the composite material can secure excellent mechanical strength and flexibility by comprising the metal foam. In addition, the composite material can secure stability against oxidation and high temperature, electrical insulation properties, and the like by appropriate compounding of a polymer component and a metal foam, and can also solve peeling problems that occur when applied to various devices. The composite material of the present application has low thermal resistance and low surface roughness, and the like, thereby being particularly suitable for a heat radiation material or a heat conduction material, and the like.

Since the composite material of the present application comprises a planarization-treated metal foam and the planarization-treated metal foam has lower surface roughness than that of other metal foams, the thermal conductivity is also excellent over the composite material that the same metal foam is applied, but the non-planarization-treated metal foam is applied. That is, the composite material of the present application has lower thermal resistance over the composite material in which it is manufactured under the same conditions, but a metal foam without planarization treatment has been applied.

The present application also relates to a use of the composite material. The present application relates to a heat radiation material comprising the composite material. The heat radiation material may be made of only the composite material. In another example, the heat radiation material comprises the composite material, but may also further comprise known constitutions or components, and the like required for the heat radiation material.

In one example, the heat radiation material may be in the form of a film or sheet, where the structure of a known film or sheet may be applied.

When the heat radiation material is in the form of a film or sheet, the material may comprise a base material and a heat radiation member provided on at least one surface of the base material, where the heat radiation member may be in the form of comprising the composite material. Since the heat radiation material applies the above-described composite material as it is, the contents of the above-described composite material and its manufacturing method may also be applied as they are to the heat radiation material in the form of a film or sheet. As the heat radiation material comprises the composite material as the heat radiation member, heat generated by a heat source adjacent to the heat radiation material can be efficiently discharged to the outside. In addition, the heat radiation material in the form of a film or sheet may also further comprise known elements required to implement its function.

In another example, it relates to a thermally conductive material comprising the composite material. The thermally conductive material may be made of only the composite material. In another example, the thermally conductive material comprises the composite material, but may also further comprise known constitutions or components, and the like required for the thermally conductive material.

Advantageous Effects

The composite material obtained in the present application may have high heat conduction efficiency.

The composite material obtained in the present application can secure stability and the like in an oxidizing and/or high-temperature atmosphere.

The composite material obtained in the present application has an advantage capable of preventing occurrence of peeling problems or the like, especially when applied as a heat radiation material or the like.

BEST MODE

Hereinafter, the present application will be described in detail through the following examples, but the scope of the present application is not limited by the following examples.

Manufacturing Example 1. Metal Foam

Copper (Cu) powder having an average particle diameter (D50 particle diameter) of about 60 μm or so was used. Texanol was used as a dispersant, and ethyl celluose was used as a binder. A slurry was prepared by mixing a solution obtained by dissolving ethyl cellulose in texanol to be a concentration of about 7 weight % with the copper power so that the weight ratio was about 1:1.

The slurry was coated in the form of a film having a thickness of about 250 μm, and dried at a temperature of about 120° C. for about 60 minutes to form a metal foam precursor. Thereafter, sintering was performed by applying an external heat source in an electric furnace so as to maintain the precursor at a temperature of about 1000° C. for about 2 hours in a hydrogen/argon atmosphere, and a metal foam was manufactured. The manufactured metal foam had a thickness of about 85 μm, a porosity of about 64%, surface roughness of about 7.5 μm or so, and thermal resistance of about 0.466 $Kin^2/W$ under a pressure condition of 20 psi. Analysis Tech's TIM Tester 1300 was used as the measuring equipment for thermal resistance, and it was measured according to the manual of the equipment (hereinafter, this was used in the same manner).

Figure 1:
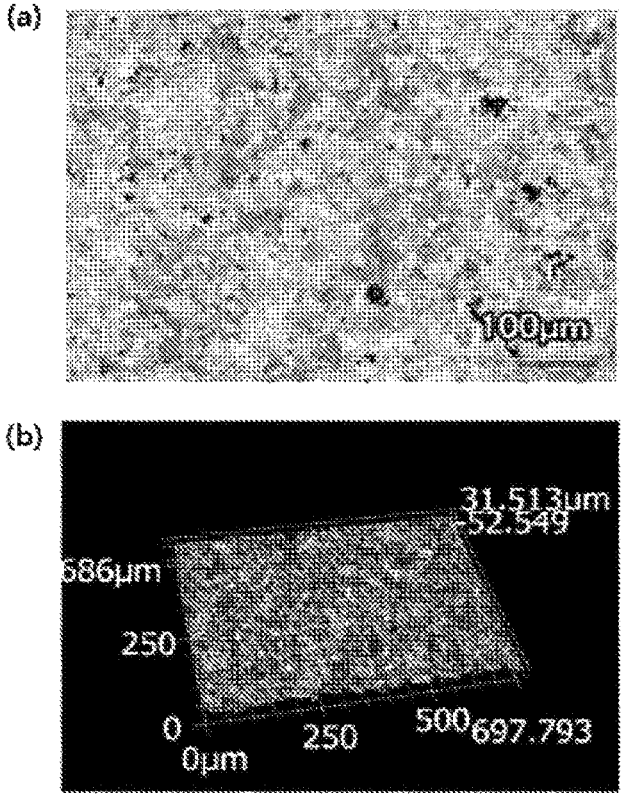
FIG. 1 is a laser micrograph of the metal foam of Manufacturing Example 1 and a surface shape analysis result thereof.

A laser micrograph of the metal foam of Manufacturing Example 1 and a surface shape analysis result thereof were shown in FIG. 1.

Manufacturing Example 2. Metal Foam

Figure 2:
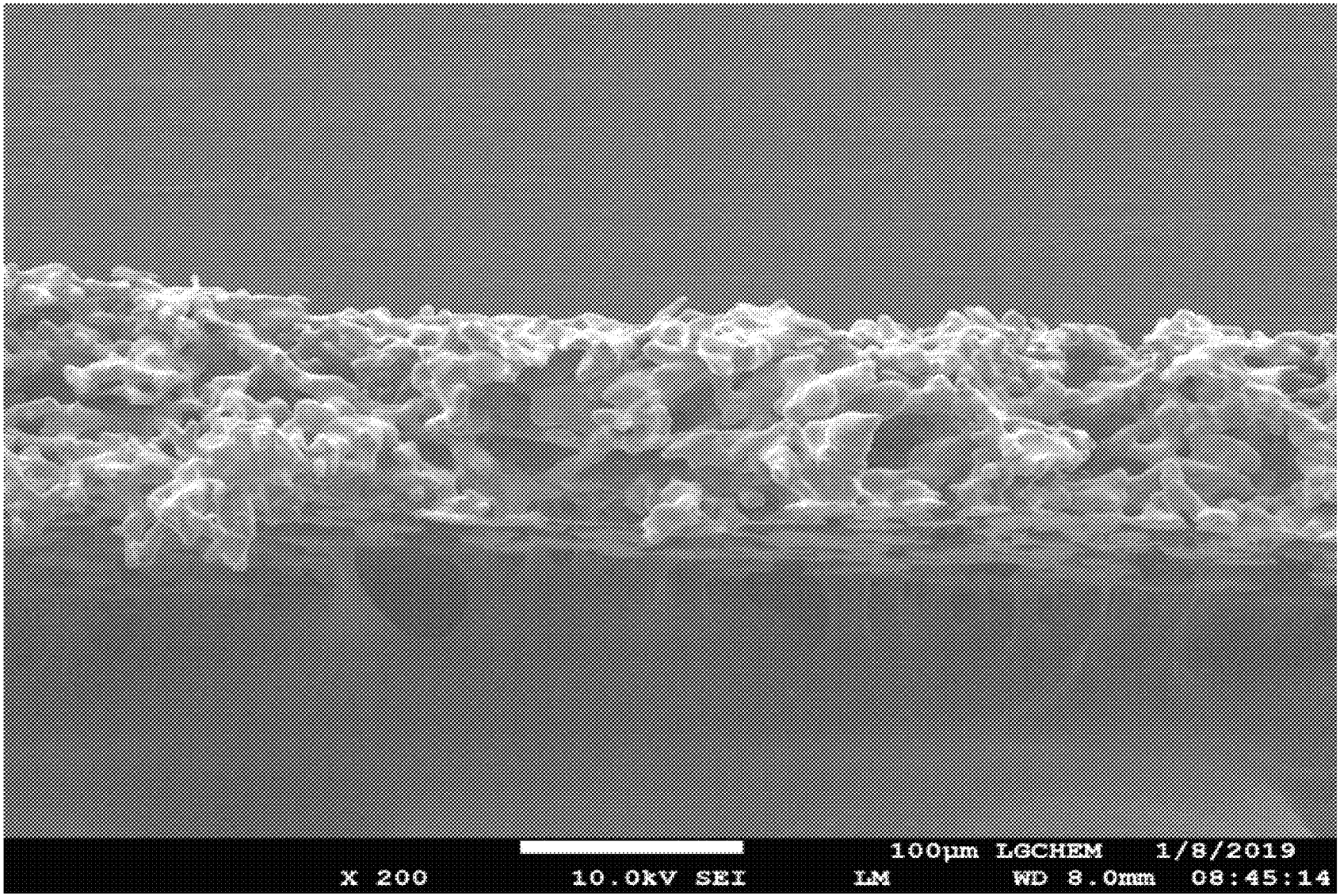
FIG. 2 is an SEM photograph of the metal foam of Manufacturing Example 2.

A metal foam was manufactured in the same manner as in Manufacturing Example 1, except that the slurry coating thickness was adjusted to about 300 μm. The manufactured metal foam had a thickness of about 100 μm, a porosity of about 64%, surface roughness of about 8 μm or so, and thermal resistance of about 0.496 $Kin^2/W$ under a pressure condition of 20 psi. The SEM photograph of the metal foam was shown in FIG. 2.

Manufacturing Example 3. Metal Foam

A metal foam was manufactured in the same manner as in Manufacturing Example 1, except that the slurry coating thickness was adjusted to about 1500 μm. The manufactured metal foam had a thickness of about 500 μm, a porosity of about 70%, surface roughness of about 9 μm or so, and thermal resistance of about 0.871 $Kin^2/W$ under a pressure condition of 20 psi.

Manufacturing Example 4. Metal Foam

A metal foam was manufactured in the same manner as in Manufacturing Example 1, except that the slurry coating thickness was adjusted to about 2500 μm. The manufactured metal foam had a thickness of about 1000 μm, a porosity of about 75%, surface roughness of about 10 μm or so, and thermal resistance of about 1.064 $Kin^2/W$ under a pressure condition of 20 psi.

Manufacturing Example 5. Metal Foam

Figure 3:
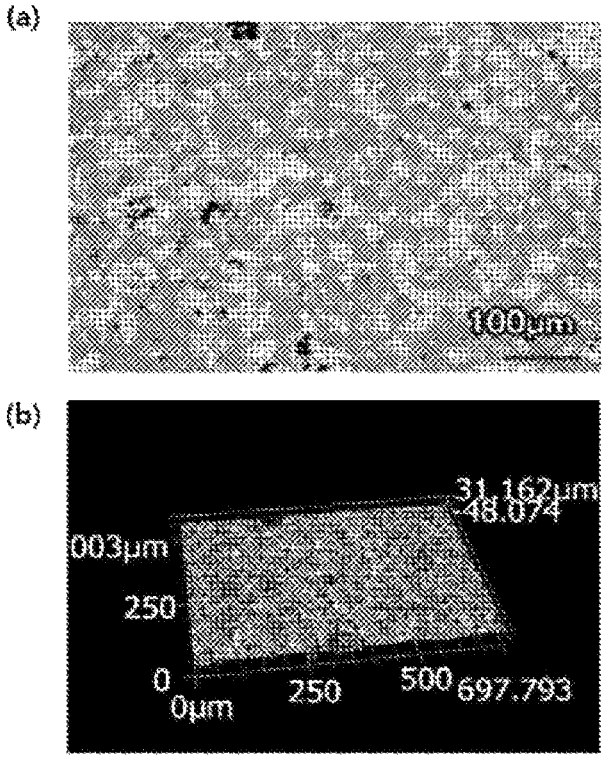
FIG. 3 is a laser micrograph of the metal foam of Manufacturing Example 5 and a surface shape analysis result thereof.

A gap between rolls of a roll press device (WCRP-1015G, Wellcos Corp) was set to 70 μm, and the metal foam of Manufacturing Example 1 was passed through the rolls of the device to manufacture a pressed metal foam. The pressed metal foam had a thickness of about 70 μm, a porosity of about 53%, surface roughness of about 5.2 μm or so, and thermal resistance of about 0.335 $Kin^2/W$ under a pressure condition of 20 psi. A laser micrograph of the metal foam of Manufacturing Example 5 and a surface shape analysis result thereof were shown in FIG. 3.

Manufacturing Example 6. Metal Foam

Figure 4:
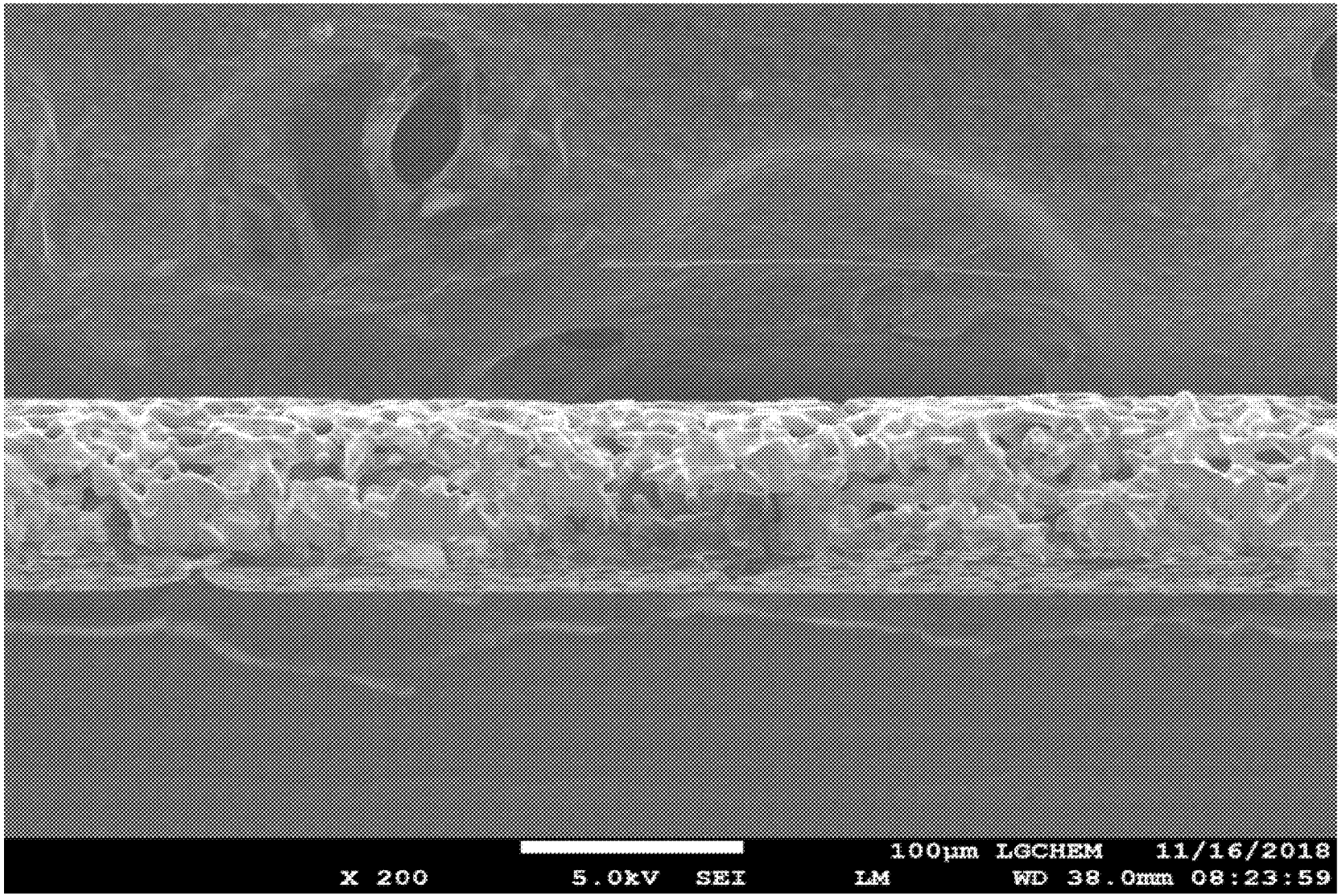
FIG. 4 is an SEM photograph of the metal foam of Manufacturing Example 6.

A gap between rolls of a roll press device (WCRP-1015G, Wellcos Corp) was set to 80 μm, and the metal foam of Manufacturing Example 2 was passed through the rolls of the device to manufacture a pressed metal foam. The pressed metal foam had a thickness of about 80 μm, a porosity of about 57%, surface roughness of about 4 μm or so, and thermal resistance of about 0.360 $Kin^2/W$ under a pressure condition of 20 psi. An SEM photograph of Manufacturing Example 6 was shown in FIG. 4.

Manufacturing Example 7. Metal Foam

A gap between rolls of a roll press device (WCRP-1015G, Wellcos Corp) was set to 300 μm, and the metal foam of Manufacturing Example 3 was passed through the rolls of the device to manufacture a pressed metal foam. The pressed metal foam had a thickness of about 300 μm, a porosity of about 55%, surface roughness of about 5 μm or so, and thermal resistance of about 0.403 $Kin^2/W$ under a pressure condition of 20 psi.

Manufacturing Example 8. Metal Foam

C6—A gap between rolls of a roll press device (WCRP-1015G, Wellcos Corp) was set to 500 μm, and the metal foam of Manufacturing Example 4 was passed through the rolls of the device to manufacture a pressed metal foam. The pressed metal foam had a thickness of about 50 μm, a porosity of about 45%, surface roughness of about 4 μm or so, and thermal resistance of about 0.527 $Kin^2/W$ under a pressure condition of 20 psi.

According to FIGS. 1 to 4, it can be confirmed that the metal foam surface is formed relatively smoothly pursuant to pressing, thereby having lower thermal resistance than that before pressing.

Example 1. Composite Material

Figure 5:
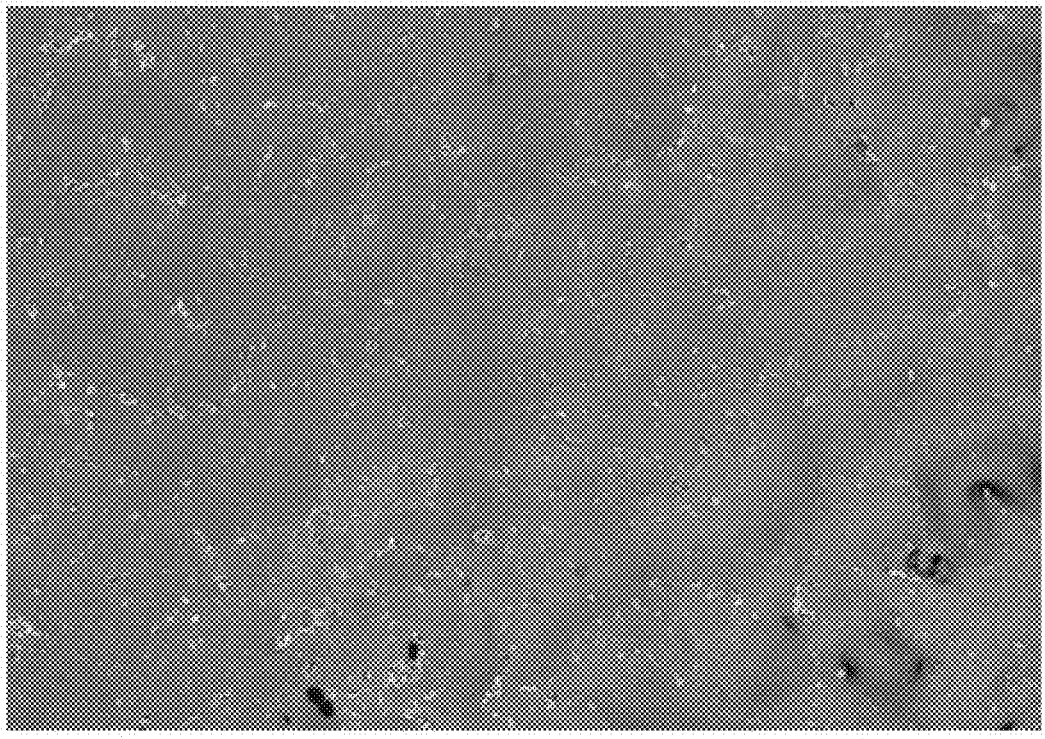
FIG. 5 is a laser micrograph of the composite material of Example 1 and a surface shape analysis result thereof.
Figure 5:
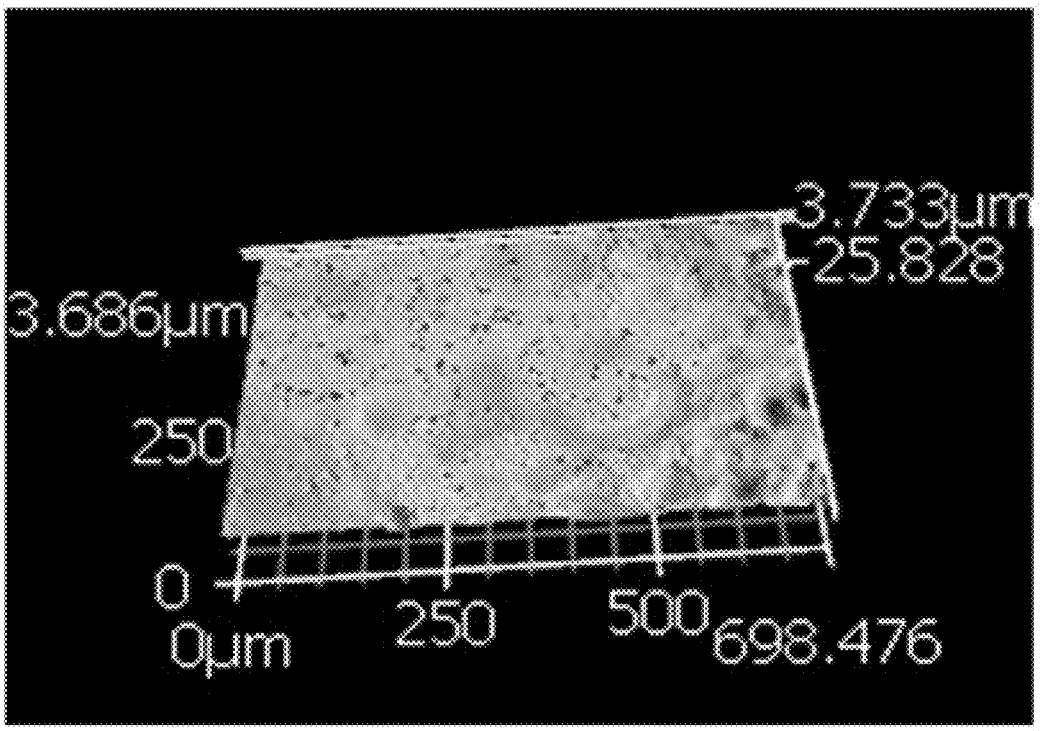
Figure 6:
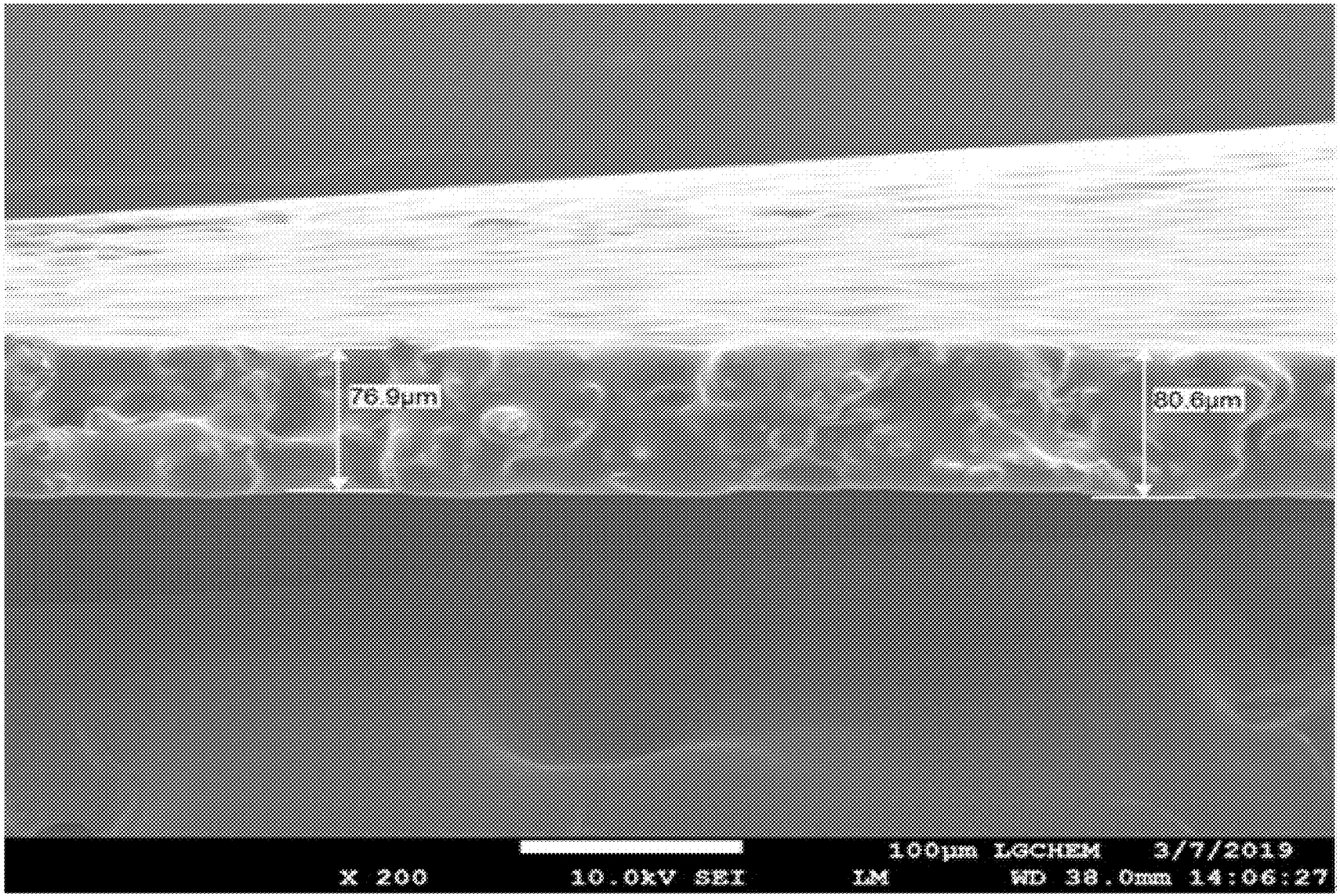
FIG. 6 is an SEM photograph of the composite material of Example 1.

The metal foam of Manufacturing Example 5 was immersed in a thermosetting silicone resin (polydimethylsiloxane, Sylgard 527 kit, Dow Corning) as a curable polymer. The excess amount of the silicone resin was removed using a film applicator so that the thickness of the curable polymer composition in which the metal foam was immersed was about 80 μm. Subsequently, the polymer composition was cured by holding it in an oven maintained at 120° C. for about 10 minutes to manufacture a film-shaped composite material. FIG. 5 is a laser micrograph of the composite material of Example 1 and a surface shape analysis result thereof, and FIG. 6 is an SEM photograph of the composite material of Example 1. The surface roughness of the composite material was about 1.2 μm, and the thermal resistance was about 0.098 $Kin^2/W$ under a pressure condition of 20 psi.

Example 2. Composite Material

Figure 7:
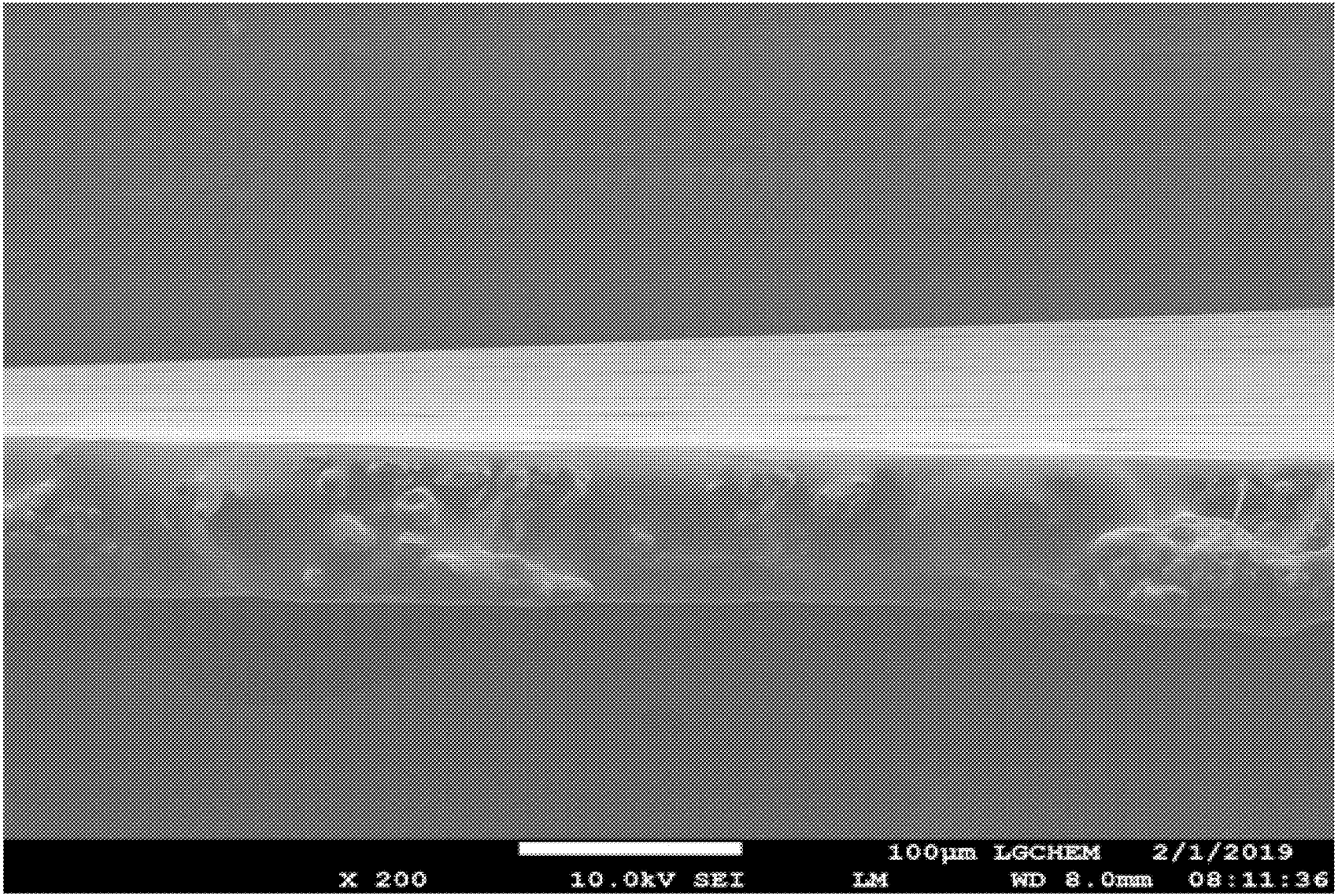
FIG. 7 is an SEM photograph of the composite material of Example 2.

A composite material was manufactured in the same manner as in Example 1, except that the metal foam of Manufacturing Example 6 was immersed instead of the metal foam of Manufacturing Example 5, and the excess amount of the silicone resin was removed using a film applicator so that the thickness of the curable polymer composition in which the metal foam was immersed was about 90 μm. FIG. 7 is an SEM photograph of the composite material of Example 2. The surface roughness of the composite material was about 1.5 μm, and the thermal resistance was about 0.102 $Kin^2/W$ under a pressure condition of 20 psi.

Example 3. Composite Material

A composite material was manufactured in the same manner as in Example 1, except that the metal foam of Manufacturing Example 7 was immersed instead of the metal foam of Manufacturing Example 5, and the excess amount of the silicone resin was removed using a film applicator so that the thickness of the curable polymer composition in which the metal foam was immersed was about 320 μm. The surface roughness of the composite material was about 1.6 μm, and the thermal resistance was about 0.226 $Kin^2/W$ under a pressure condition of 20 psi.

Example 4. Composite Material

A composite material was manufactured in the same manner as in Example 1, except that the metal foam of Manufacturing Example 8 was immersed instead of the metal foam of Manufacturing Example 5, and the excess amount of the silicone resin was removed using a film applicator so that the thickness of the curable polymer composition in which the metal foam was immersed was about 525 μm. The surface roughness of the composite material was about 1.8 μm, and the thermal resistance was about 0.315 $Kin^2/W$ under a pressure condition of 20 psi.

Comparative Example 1. Composite Material

Figure 8:
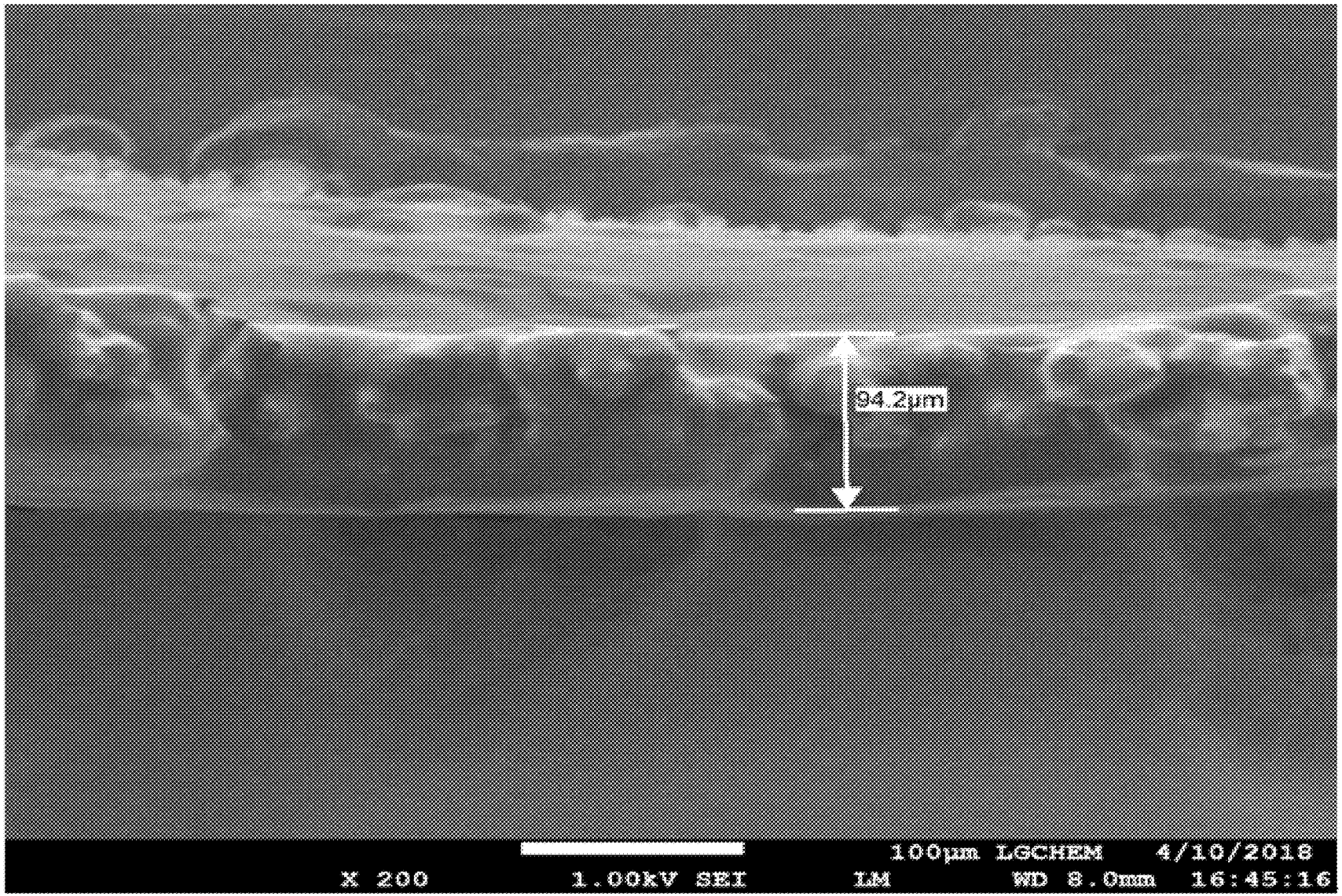
FIG. 8 is an SEM photograph of the composite material of Comparative Example 1.

A composite material was manufactured in the same manner as in Example 1, except that the metal foam of Manufacturing Example 1 was immersed instead of the metal foam of Manufacturing Example 5, and the excess amount of the silicone resin was removed using a film applicator so that the thickness of the curable polymer composition in which the metal foam was immersed was about 100 μm. FIG. 8 is an SEM photograph of the composite material of Comparative Example 1. The surface roughness of the composite material was about 2.5 μm, and the thermal resistance was about 0.203 $Kin^2/W$ under a pressure condition of 20 psi.

Comparative Example 2. Composite Material

Figure 9:
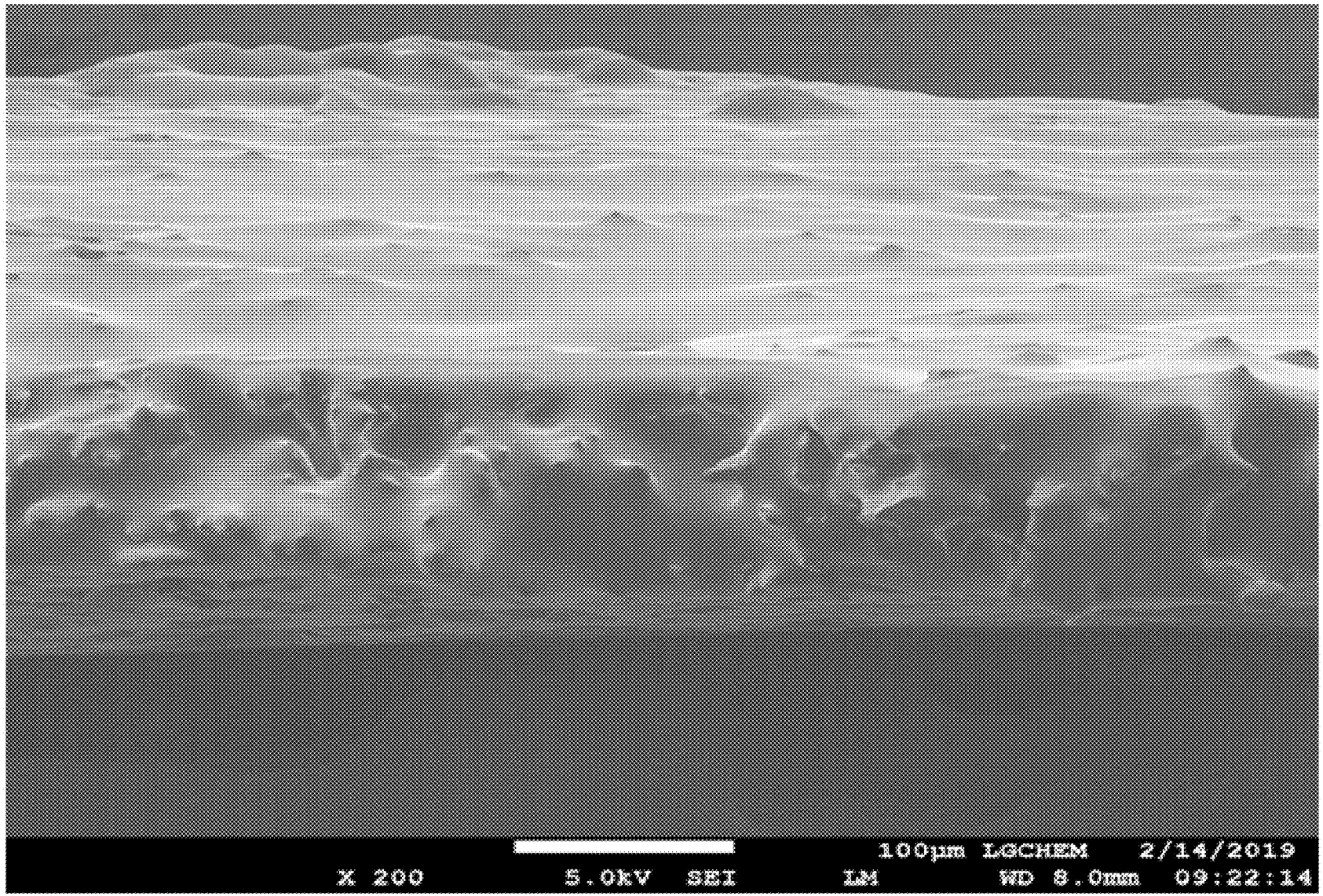
FIG. 9 is a SEM photograph of the composite material of Comparative Example 2.

A composite material was manufactured in the same manner as in Example 1, except that the metal foam of Manufacturing Example 2 was immersed instead of the metal foam of Manufacturing Example 5, and the excess amount of the silicone resin was removed using a film applicator so that the thickness of the curable polymer composition in which the metal foam was immersed was about 110 μm. FIG. 9 is an SEM photograph of the composite material of Comparative Example 2. The surface roughness of the composite material was about 2.4 μm, and the thermal resistance was about 0.236 $Kin^2/W$ under a pressure condition of 20 psi.

Comparative Example 3. Composite Material

A composite material was manufactured in the same manner as in Example 1, except that the metal foam of Manufacturing Example 3 was immersed instead of the metal foam of Manufacturing Example 5, and the excess amount of the silicone resin was removed using a film applicator so that the thickness of the curable polymer composition in which the metal foam was immersed was about 530 μm. The surface roughness of the composite material was about 3.2 μm, and the thermal resistance was about 0.652 $Kin^2/W$ under a pressure condition of 20 psi.

Comparative Example 4. Composite Material

A composite material was manufactured in the same manner as in Example 1, except that the metal foam of Manufacturing Example 4 was immersed instead of the metal foam of Manufacturing Example 5, and the excess amount of the silicone resin was removed using a film applicator so that the thickness of the curable polymer composition in which the metal foam was immersed was about 1050 μm. The surface roughness of the composite material was about 3.0 μm, and the thermal resistance was about 0.783 $Kin^2/W$ under a pressure condition of 20 psi.

The physical property analysis results of the composite materials of Examples and Comparative Examples were shown in Tables 1 and 2 below.

TABLE 1

| | Example | | | |
|---|---|---|---|---|
| | 1 | 2 | 3 | 4 |
| Applied metal foam | Manufacturing Example 5 | Manufacturing Example 6 | Manufacturing Example 7 | Manufacturing Example 8 |
| Surface roughness | 1.2 | 1.5 | 1.6 | 1.8 |
| Thermal resistance @20 psi($Kin^2/W$) | 0.098 | 0.102 | 0.226 | 0.315 |

TABLE 2

| | Comparative Example | | | |
|---|---|---|---|---|
| | 1 | 2 | 3 | 4 |
| Applied metal foam | Manufacturing Example 1 | Manufacturing Example 2 | Manufacturing Example 3 | Manufacturing Example 4 |
| Surface roughness | 2.5 | 2.4 | 3.2 | 3.0 |
| Thermal resistance @20 psi ($Kin^2/W$) | 0.203 | 0.236 | 0.652 | 0.783 |

According to Tables 1 and 2, it can be confirmed that the composite materials manufactured through the planarization treatment, specifically the composite materials of Examples 1 to 4 manufactured using the pressed metal foams have the lower surface roughness relative to the thickness than that of the composite materials of Comparative Examples and have reduced thermal resistance. Through this, it can be seen that when a composite material is manufactured with a planarization treatment as in the method of the present application, the surface roughness and thermal conductivity of the composite material can be improved.

What is claimed is:

1. A method for manufacturing a composite material, the method comprising steps of:

(a) providing a metal foam;

(b) preparing a mixture comprising the metal foam and a curable polymer;

(c) curing the curable polymer of the mixture to obtain the composite material; and (d) performing a planarization treatment on at least one of the metal foam before preparing the mixture, the mixture before curing the curable polymer, or the composite material, wherein the step (d) is performed on the metal foam before the step (b), and wherein after the step (d) is performed, a porosity of the metal foam is in a range of 30% to 60%.

2. A method for manufacturing a composite material, the method comprising steps of:

(a) providing a metal foam;

(b) preparing a mixture comprising the metal foam and a curable polymer;

(c) curing the curable polymer of the mixture to obtain the composite material; and (d) performing a planarization treatment on at least one of the metal foam before preparing the mixture, the mixture before curing the curable polymer, or the composite material, wherein the step (d) is performed on the metal foam before the step (b), and wherein after the step (d) is performed, a surface roughness of the metal foam is 6 μm or less.

3. The method for manufacturing the composite material according to claim 1, wherein the step (d) is performed by polishing or pressing.

4. The method for manufacturing the composite material according to claim 3, wherein the pressing is performed by a roll press.

5. A method for manufacturing a composite material, the method comprising steps of:

(a) providing a metal foam;

(b) preparing a mixture comprising the metal foam and a curable polymer;

(c) curing the curable polymer of the mixture to obtain the composite material; and (d) performing a planarization treatment on at least one of the metal foam before preparing the mixture, the mixture before curing the curable polymer, or the composite material, wherein the step (a) is performed in a manner comprising (a1) a process of manufacturing a green structure using a slurry comprising a metal powder, a binder and a dispersant, and (a2) a process of sintering the green structure.

6. The method for manufacturing the composite material according to claim 1, wherein a ratio (TA/TB) of a first thickness (TA) of the metal foam after performing the planarization treatment to a second thickness (TB) of the metal foam before performing the planarization treatment is 0.9 or less.

7. A method for manufacturing a composite material, the method comprising steps of:

(a) providing a metal foam;

(b) preparing a mixture comprising the metal foam and a curable polymer;

(c) curing the curable polymer of the mixture to obtain the composite material; and (d) performing a planarization treatment on at least one of the metal foam before preparing the mixture, the mixture before curing the curable polymer, or the composite material, wherein the step (d) is performed on the metal foam before the step (b), and wherein a ratio (RA/RB) of a first surface roughness (RA) of the metal foam after performing the planarization treatment to a second surface roughness (RB) of the metal foam before performing the planarization treatment is 0.9 or less.

8. A method for manufacturing a composite material, the method comprising steps of:

(a) providing a metal foam;

(b) preparing a mixture comprising the metal foam and a curable polymer;

(c) curing the curable polymer of the mixture to obtain the composite material; and (d) performing a planarization treatment on at least one of the metal foam before preparing the mixture, the mixture before curing the curable polymer, or the composite material, wherein the step (d) is performed on the metal foam before the step (b), and wherein a ratio (KA/KB) of a first thermal resistance (KA) of the metal foam after performing the planarization treatment to a second thermal resistance (KB) of the metal foam before performing the planarization treatment is 0.9 or less.

* * * * *